United States Patent [19]

Mayer

[11] 4,366,857

[45] Jan. 4, 1983

[54] MAGNETIC TWO-PHASE THERMOSIPHON

[75] Inventor: Arnold H. Mayer, Dayton, Ohio

[73] Assignee: The United States of America as represented by the Secretary of the Air Force, Washington, D.C.

[21] Appl. No.: 258,341

[22] Filed: Apr. 28, 1981

[51] Int. Cl.[3] ..... F28D 15/00

[52] U.S. Cl. ..... 165/104.23; 417/48; 417/207

[58] Field of Search ..... 165/104.23, 104.28; 417/48, 50

[56] References Cited

U.S. PATENT DOCUMENTS 3,682,239 8/1972 Abu-Romia ..... 417/48 X

FOREIGN PATENT DOCUMENTS 55-134289 10/1980 Japan ..... 165/104.23
515021 6/1976 U.S.S.R. ..... 165/104.28
616519 7/1978 U.S.S.R. ..... 165/104.23

OTHER PUBLICATIONS

Hwang, U. P., *Magnetic Wickless Heat Pipe,* IBM Technical Disclosure Bulletin, vol. 13, No. 11, 4/71, p. 3445.

*Primary Examiner*—Albert W. Davis, Jr.
*Attorney, Agent, or Firm*—Donald J. Singer; Bobby D. Scearce

[57] ABSTRACT

A heat pipe or thermosiphon device is provided which may be configured for operation in various temperature regimes from cryogenic to elevated temperatures and in gravity or other orientation sensitive environments, as well as zero-gravity or other orientation insensitive environments. The invention comprises a heat pipe, containing a magnetically susceptible liquid as the working fluid, surrounded by an electro-magnet or permanent magnet which produces a magnetic field gradient which interacts with the magnetically susceptible liquid to produce an artificial body force field analogous to, but which may be substantially greater than, the gravitational force field, for separation of the liquid from gaseous phases of the magnetically susceptible working fluid within the heat pipe.

7 Claims, 8 Drawing Figures

MAGNETIC TWO-PHASE THERMOSIPHON

RIGHTS OF THE GOVERNMENT

The invention described herein may be manufactured and used by or for the Government of the United States for all governmental purposes without the payment of any royalty.

BACKGROUND OF THE INVENTION

This invention relates generally to thermosiphon or heat pipe devices for removing from a heat generating system or reservoir large quantities of heat by vaporization of a liquid at one end of the device and condensation of the vapor so produced at another end. More specifically, this invention relates to an improved thermosiphon or heat pipe device utilizing a diamagnetic or paramagnetic fluid which may be circulated through the device by the imposition of a magnetic field gradient.

The use of a thermosiphon for the extraction of large quantities of heat from a heat generating system provides certain well known advantages over cooling systems utilizing single phase heat transfer media, particularly as regards its great capacity for heat extraction over a relatively small temperature differential between heat source and heat sink. However, thermosiphons require for their operation an externally applied gravitational or rotating inertial force field to effect separation of the gaseous phase from liquid phase of the heat transfer medium. One conventional heat pipe configuration utilizes a wick to separate the phases and to return the liquid phase to the hot (evaporator) end of the heat pipe through the wick by capillary action. One wickless configuration employs an internally tapered tube spinning about its axis whereby centrifugal force returns the condensed liquid phase of the heat transfer medium to the larger diameter evaporator end of the device.

Conventional thermosiphon configurations therefore are limited in their use in zero-gravity or other orientation insensitive environments, while conventional wick configured heat pipes are limited in their use in a gravity environment.

The present invention comprises a two-phase heat pipe utilizing an artificial body force field analogous to the gravitational field in which all the fluid convective phenomena observed in the latter can occur with controlled intensity and independently of orientation. This invention has significant advantage over prior art devices in that it generates its own body force field induced in paramagnetic or diamagnetic working fluids by magnetic field gradients. By proper choice of magnetically susceptible working fluids, the invention may be applicable within various temperature ranges from cryogenic through ambient and elevated temperatures. Permanent magnet or electromagnetic means may be used for producing the magnetic field gradients for pumping a magnetically susceptible working fluid such as certain organic liquids, such as benzene, saturated and unsaturated hydrocarbons of the methane, ethylene, and acetylene series of homologous organic compounds, the halocarbons, rare gases, and hydrides. As a result of heat addition at the evaporator end of the device some of the magnetically susceptible liquid is vaporized producing an imbalance in hydrostatic pressure at one extremity of parallel liquid and vapor filled columns of one embodiment, thereby inducing gross circulation of liquid from the denser to the more rarefied fluid mixture column. At the other extremity, the parallel columns communicate through a passage, which allows vapor to contact a condenser located near the liquid column where the vapor condenses and returns to the liquid column. The magnetic gradient may be produced by conductor coils surrounding the heat pipe wherein the density of windings varies over the region occupied by the liquid and vapor columns. The heat pipe may be constructed of suitable non-ferromagnetic material such as aluminum, glass, copper and brass.

The magnetic body force field of this invention which acts upon the magnetically susceptible working liquid within the heat pipe may be made to be substantially greater than the gravitational force and provides a means of establishing an intrinsic body force field that remains virtually undisturbed by the variable g-forces induced by an accelerating coordinate system. This invention will allow the high intensity heat transfer mechanisms of boiling and condensation to be applied to the task of recouping on-board waste heat to power environmental control systems and possibly other subsystems and to render such heat power cycles insensitive to accelerations. The invention may be used for cryogenic heat pipes associated with optical sensor cooling, in heat pipes based on liquid metals and fused salts, and in cooling applications for special purpose high power systems and magneto-hydrodynamic generators.

The invention described herein, therefore, provides an improved heat pipe using a diamagnetic or paramagnetic fluid in a body force field produced by an imposed magnetic field gradient, wherein the field gradient may be produced by an electromagnet, comprising a graduated winding density, or permanent magnets having a field gradient such as would be produced by conical configuration of permanent super magnets such as samarium cobalt; permanent and superconducting magnets may be used to minimize energy consumption of the heat pipe device of this invention.

It is, therefore, an object of this invention to provide an improved thermosiphon or heat pipe device.

It is a further object of this invention to provide a heat pipe operable in various temperature regimes.

It is still a further object of this invention to provide a heat pipe operable in zero-gravity or other orientation insensitive environments.

It is a further object of this invention to provide a heat pipe operable in an environment wherein gravitational forces may need to be overcome.

These and other objects of the invention will become apparent as the description thereof proceeds.

SUMMARY OF THE INVENTION

In accordance with the foregoing principles and objects of the present invention, a heat pipe or thermosiphon device is provided which may be configured for operation in various temperature regimes from cryogenic to elevated temperatures and in gravity or other orientation sensitive environments, as well as zero-gravity or other orientation insensitive environments. The invention comprises a heat pipe, containing a magnetically susceptible liquid as the working fluid, surrounded by an electro-magnet or permanent magnet which produces a magnetic field gradient which interacts with the magnetically susceptible liquid to produce an artificial body force field analogous to, but which may be substantially greater than, the gravitational force field, for separation of the liquid from gaseous phases of the magnetically susceptible working fluid within the heat pipe.

DESCRIPTION OF THE DRAWINGS

The invention will be more clearly understood from the following detailed description of specific embodiments thereof read in conjunction with the accompanying drawings wherein.

DETAILED DESCRIPTION

Figure 1:
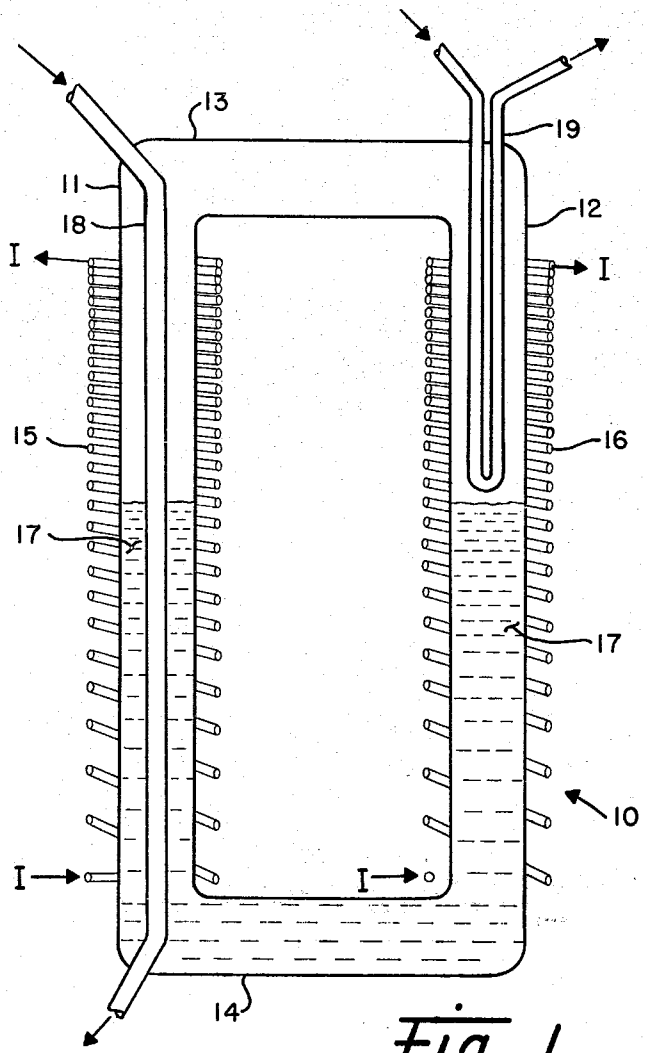
FIG. 1 is a cross-sectional schematic representation of one embodiment of the present invention showing a two-column configuration for the evaporator and condenser extremities of the invention.

Referring to the figures, the invention may be understood by examination of the embodiment shown in FIG. 1. A cross-sectional view of a parallel column configuration heat pipe 10 is shown therein comprising two hollow cylindrical columns 11 and 12, which, in the embodiment shown, communicate with each other at one extremity through vapor passageway 13, and at the other extremity through liquid passageway 14. Columns 11 and 12 may be constructed of any suitable non-ferromagnetic material, such as aluminum, copper, brass or glass, and therefore, material selection for the columns is not critical to the invention described herein, so long as the material allows the maintenance of a magnetic field within the heat pipe, and so long as structural integrity is assured. Coaxially disposed around each column 11 and 12 are means for producing a magnetic field gradient within and along the length of each column. In the embodiment shown in FIG. 1, the magnetic field gradient is produced by means of electromagnets 15 and 16 each having a winding density of conductors (number of turns per unit axial distance) which is not uniform, but increases, in the manner shown schematically in FIG. 1, along the length of columns 11 and 12 to produce a desired magnetic field gradient within columns 11 and 12. Magnets 15 and 16 of the embodiment shown may comprise superconducting electromagnets coaxially disposed around columns 11 and 12 substantially as shown in FIG. 1, for maintenance of the field at cryogenic temperatures. The superconducting electromagnets may be contained in an annularly shaped dewar (not illustrated in FIG. 1) containing a cryogen, such as liquid helium, and may comprise such as niobium-tin alloy windings embedded in an aluminum matrix, or other superconducting metal coils embedded in such as a copper matrix, or other superconducting electromagnet configurations. For operation at ambient or elevated temperatures, magnets 15 and 16 may comprise any wound electromagnet or permanent magnet configuration.

Columns 11 and 12 are partially filled with a suitable magnetically susceptible liquid 17, such as normal hexane, having additionally the desirable thermodynamic properties to serve the function, hereinbelow described, as the heat exchange medium. For operation of the heat pipe of this invention at cryogenic temperatures, liquid 17 may comprise such as neon, argon, krypton, xenon, nitrogen, oxygen, fluorine, chlorine, or other materials which demonstrate desirable degrees of magnetic susceptibility. At ambient or higher temperatures certain organic liquids such as halocarbons, alkanes, alkenes, alkynes, or other organic liquids as mentioned above may be desirable for use in a specific application of the present invention.

The hot end or evaporator portion of the embodiment of FIG. 1 is represented schematically as evaporator 18 comprising a conduit disposed within column 11 and contacting liquid 17 therein. Evaporator 18 may have an inlet and outlet as indicated by the arrows at convenient locations along column 11, such as shown, for conducting hot fluid from which heat is to be extracted by the heat pipe 10 of this embodiment. The cold end or condenser portion of the heat pipe 10 of FIG. 1 is represented schematically as condenser 19 comprising a cooling coil having an inlet and outlet for conducting coolant therethrough as indicated by the arrows at each end of said condenser 19.

The heat pipe 10 shown in FIG. 1 may operate as follows: liquid 17 contacts evaporator 18 within column 11 and is vaporized through the absorption of heat from evaporator 18; the vapors pass through vapor passageway 13 to condenser 19 on which the vapors are condensed and returned to column 12 as liquid 17. The convective heat transfer phenomena within the system shown require the separation of the vapor phase from the liquid 17 phase. In a zero-gravity or other orientation insensitive environment, the separation of phases of liquid 17 to promote heat transfer to the liquid 17 boiling at the evaporator followed by heat extraction by condensation at the condenser is affected by the interaction of suitable magnetically susceptible liquid 17 with the magnetic field and gradient imposed by electromagnets 15 and 16.

In the interaction between the magnetic field produced by the magnets of this invention and the magnetically susceptible liquid contained within the heat pipe and acting as the heat transfer medium of this invention, the force acting on the liquid is proportional to the product of the magnetic field strength and the axial gradient of the field strength. Therefore, if a diamagnetic liquid (most organic fluids) is used as the heat transfer medium, a magnetic field is imposed which increases from the evaporator end to the condenser end of the heat pipe (such as shown in FIG. 1), in order for the liquid to be forced toward the hot end of the heat pipe in a zero-gravity environment. Conversely, if a paramagnetic liquid (such as oxygen) is used, a magnetic field decreasing from evaporator to condenser is imposed to effect contact of the liquid with the evaporator end of the heat pipe.

Calculations of the interaction of a magnetic force field gradient which may be produced in one of columns 11 or 12 by an electromagnet such as electromagnets 15 or 16, with suitable liquid 17 having magnetic susceptibility of that of normal hexane, show that for an imposed magnetic field of 1.5 Tesla, and a magnetic field gradient of 1.5 Tesla/meter, the body force field experienced by liquid 17 (normal hexane) will be approximately 1.97 times the field experienced by liquid 17 (normal hexane) in a normal gravitational field. An imposed magnetic field of 2.12 Tesla and field gradient of 2.12 Tesla/meter will produce a field approximately four times the gravitational field. Such fields are well within the capability of superconducting magnets. Further, it follows that, if superconducting electromagnet 15 or 16 of this invention comprise conductors 1/32 inch square wound on a coil one inch thick, then the current I (see FIG. 1) required is approximately 295 amps per turn, which is well within electromagnet wire capability.

Figure 2:
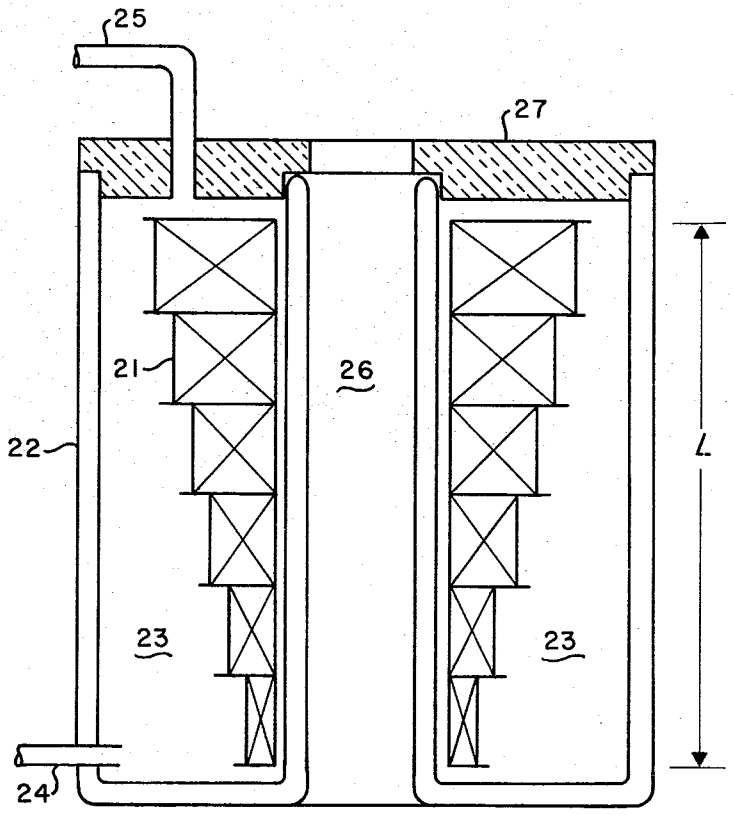
FIG. 2 is a cross-sectional schematic of a representative cryogenic dewar and superconducting electromagnet configuration for containing a heat pipe of this invention and for producing the magnetic field gradient for phase separation of the working liquid within the heat pipe.

As shown in FIG. 2, the magnetic field and field gradient for operation at cryogenic temperatures needed to sustain the superconducting state may be produced in a superconducting electromagnet 21 comprising a plurality of stacked annularly-shaped coil magnets, having varying numbers of turns, to produce a magnetic field gradient from one end thereof to the other. Electromagnet 21 of FIG. 2 may be disposed in an annularly-shaped dewar 22 containing a cryogen 23, such as liquid helium. The open end of dewar 22 may be provided with suitable thermal insulation 27 secured conventionally. Dewar 22 may have inlet tube 24 for the introduction of liquid cryogen 23 thereinto, and outlet tube 25 to remove boil-off, and is of convenient size and shape to define, and to center magnet 21 around, cavity 26 which may be of a size suitable to receive a heat pipe (not shown in FIG. 2), such as hereinbelow described in relation to FIGS. 3–7. The various coils of magnet 21 may need to be securely assembled, such as by providing means (not shown) to bolt them together, to maintain their physical integrity under the magnetic forces produced within magnet 21.

For a constant body force field to be produced within the cavity 26 surrounded by magnet 21 of FIG. 2, the product of the magnetic field and the field gradient is to good approximation maintained constant. Therefore, as discussed above, and using normal hexane as a diamagnetic working liquid within the heat pipe, and an imposed maximum magnetic field of 1.5 Tesla, with a minimum gradient of 1.5 Tesla, a value of L (length of magnet 21 corresponding to the working length of the heat pipe) of 0.5 meter will produce a field twice the gravitational field. A 2.12 Tesla field having a minimum 2.12 Tesla/meter gradient, producing a force four times gravity as discussed above, requires a length L of about 0.7 meter.

In zero-gravity environment, the production and maintenance of fields and gradients of size just mentioned may not be needed to effect the separation of phases of the magnetically susceptible liquid. The fields and gradients required for such application may be produced by electromagnets and permanent magnets operable at temperatures higher than that required for superconducting electromagnets.

Various representative configurations of heat pipes which may be used within the scope of this invention are presented schematically in FIGS. 3–7.

Figure 3:
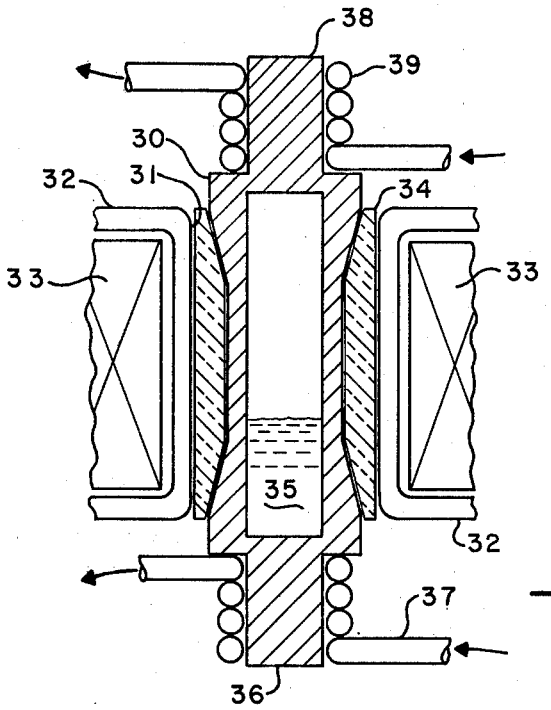
FIGS. 3 and 4 schematically illustrate two embodiments of the heat pipe of this invention demonstrating alternative evaporator and condenser configurations for the invention.
Figure 4:
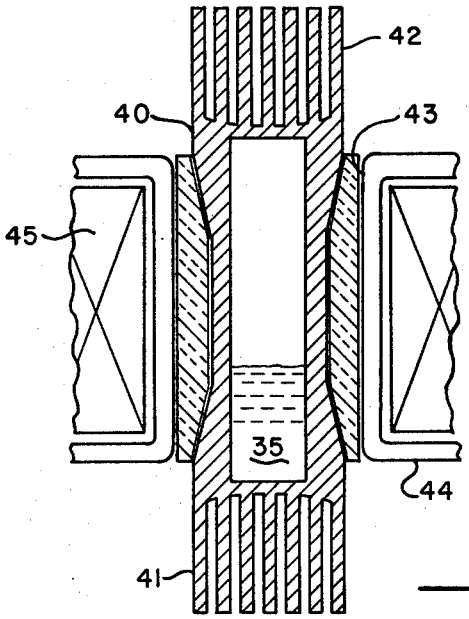

The configurations shown in FIGS. 3 and 4 show typically how the heat pipe of the present invention may function to effect heat exchange between hot and cold reservoirs. Referring first to FIG. 3, a heat pipe 30 of this invention may be of generally tubular configuration and is shown schematically disposed within cavity 31 of annular liquid cryogen-filled dewar 32 coaxially disposed around heat pipe 30. Thermal insulation 34 may be placed around heat pipe 30 to conventionally insulate heat pipe 30 within cavity 31. Heat pipe 30 of FIG. 3, as well as all other heat pipes shown schematically in FIGS. 4–8, may be constructed of suitable nonmagnetic material. Magnetically susceptible liquid 35 partially fills heat pipe 30 as shown. Evaporator end 36 of heat pipe 30 is heated by heating coil 37 through which hot fluid may flow as indicated by the arrows from a system (not shown) from which it is desired to extract heat. Condenser end 38 of heat pipe 30 is cooled by cooling coil 39 through which a coolant fluid may flow as indicated by the arrows. In operation, in the absence of gravitational forces, evaporator end 36 of heat pipe 30 is heated by heating coil 37 causing liquid 35 to boil. Vapors from the boiling of liquid 35 contact the inner surface of the end of heat pipe 30 which is cooled by cooling coil 39. Magnet 33, having suitable magnetic field strength and gradient produces a magnetic force which interacts with magnetically susceptible liquid 35 to force liquid 35 toward evaporator end 36 of heat pipe 30 and thereby maintain phase separation of liquid 35 from its vapors.

FIG. 4 shows an alternate configuration wherein heat pipe 40, partially filled with magnetically susceptible liquid 35, has heating fins 41 at the evaporator end, and cooling fins 42 at the condenser end. In a manner similar to the configuration of FIG. 3, heat pipe 40 may be disposed within cavity 43 of annularly-shaped dewar 44 containing magnet 45. Heat pipe 40 may then operate substantially the same as heat pipe 30 of FIG. 3, except heat may be extracted from a heat source (not shown) which may be made to contact fins 41, resulting in boiling of liquid 35, and concensation of the vapors may be effected by cooling of fins 42 by contact thereof with a suitable cold reservoir (not shown).

Figure 5:
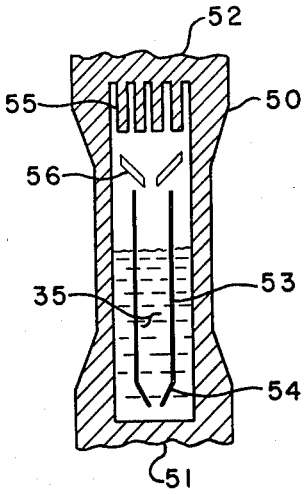
FIGS. 5, 6 and 7 schematically illustrate certain alternative internal configurations of the invention for enhancement of the heat exchange process within the heat pipe.
Figure 6:
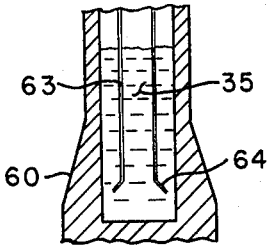
Figure 7:
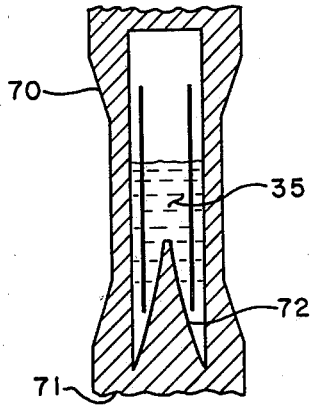

Certain internal details of the heat pipe of this invention which are not essential to the operation thereof but may enhance performance are shown in FIGS. 5, 6 and 7. Maximum heat transfer may be achieved when a column of boiling liquid communicates with a column of liquid which is made to boil less violently. Under this condition, the static pressure difference between the two columns which represents the driving force for liquid flow to the heated surface is maximum. This may be achieved by providing the internal configuration as shown in FIG. 5 wherein heat pipe 50, having heated end 51 and cooled end 52, has coaxially disposed therein central tube 53 which terminates near heated end 51 with restriction 54 having a reduced diameter. Alternatively, as shown in FIG. 6, central tube 63 may terminate with flared portion 64. The purpose of restriction 54 of FIG. 5 and flared portion 64 of FIG. 6 is to direct boiloff of magnetically susceptible liquid 35 into the annular space surrounding central tube 53 of heat pipe 50 (FIG. 5) and into central tube 63 in the embodiment represented by heat pipe 60 (FIG. 6), either of which configuration will promote gross circulation of liquid and vapor within the heat pipe.

Alternative configurations of promoting heat transfer from the evaporator end to the condenser end may be provided by such as internal fins 55 of FIG. 5 which has the effect of increasing the surface area of cooled end 52 of heat pipe 50 which is exposed to vapors of liquid 35. Further, a conical member 56 may be disposed with the heat pipe 50 such as shown in FIG. 5 to direct the flow of condensed liquid 35 into central tube 53, and to prevent splashing liquid onto condenser fins 55. The surface area of the evaporator end of the heat pipe which is exposed to liquid 35 may be similarly increased, or as shown in FIG. 7, evaporator end 71 of heat pipe 70 may have, on the interior surface thereof, upwardly extending portion 72 to increase the heated surface area of evaporator end 71 exposed to magnetically susceptible liquid 35.

Figure 8:
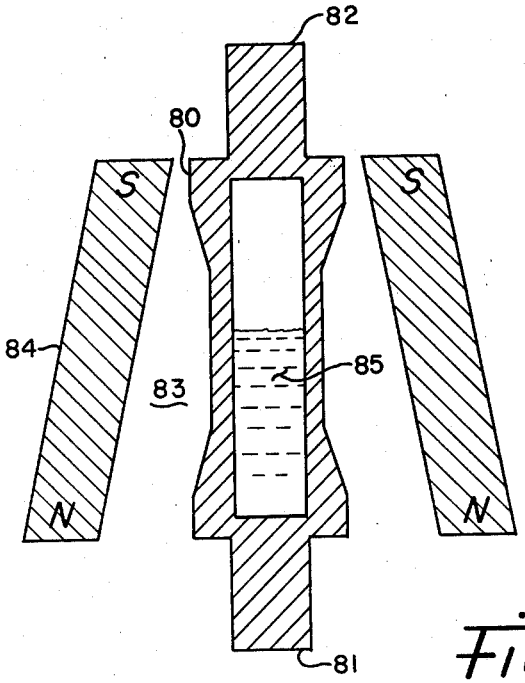
FIG. 8 is a cross-sectional schematic of a permanent magnet configuration useful to produce a magnetic field gradient of this invention.

FIG. 8 illustrates an embodiment of this invention wherein the magnetic field gradient is produced using a permanent magnet. As shown in FIG. 8, heat pipe 80 of this invention, having evaporator end 81 and condenser end 82, may be disposed coaxially within the cavity 83 of permanent magnet 84 (shown in cross-section) in the shape of a truncated cone. The geometric shape and size of, and material selection for, magnet 84 will control the magnitude of the magnetic field and gradient produced within heat pipe 80. This configuration may be especially well suited for ambient or elevated temperature application of the present invention, and suitable permanent magnet materials of which magnet 84 is comprised may include samarium cobalt or other rare earth supermagnets, aluminum-nickel-cobalt magnetic materials, or the like. Suitable magnetically susceptible working liquid may include those discussed above for ambient or higher temperature operation.

The present invention, as hereinabove described, therefore provides a novel thermosiphon device or heat pipe which may be configured for operation over a wide range of temperatures from cryogenic to elevated temperature, and which may operate in a zero-gravity or other orientation insensitive environment, as well as within gravity, accelerated, or inertial fields or other orientation sensitive environments.

It is understood that the size, shape and materials of construction of the present invention or of its component parts may be varied, or the configuration of the various parts may be altered within the scope of the appended claims, as might occur to one with skill in the field of the present invention. Therefore, all embodiments contemplated hereunder have not been shown in complete detail. Other embodiments may be developed without departing from the spirit of this invention or from the scope of the appended claims.

I claim:

1. A heat pipe device comprising:

a. a closed, generally tubular member having a first end and a second end;

b. means for heating said first end, and means for cooling said second end of said tubular member;

c. a magnetically susceptible liquid disposed within said tubular member, said liquid serving as the heat exchange medium within said tubular member by vaporization of said liquid near said first end and condensation near said second end; and d. means, adjacent said tubular member, for producing within said tubular member a magnetic field which increases along the length of said tubular member from one of said ends to the other, said magnetic field interacting with said liquid to force said liquid toward said first end and thereby effect phase separation of said liquid from its vapor.

2. The heat pipe device as recited in claim 1 wherein said magnetically susceptible liquid is a diamagnetic liquid and said magnetic field producing means maintains a magnetic field which increases from said first end to said second end of said tubular member.

3. The heat pipe device as recited in claim 1 wherein said magnetically susceptible liquid is a paramagnetic liquid and said magnetic field producing means maintains a magnetic field which increases from said second end to said first end of said tubular member.

4. The heat pipe device as recited in claims 1, 2, or 3, wherein said means for producing a magnetic field is an electromagnet.

5. The heat pipe device as recited in claims 1, 2, or 3, wherein said means for producing a magnetic field is a permanent magnet.

6. The heat pipe device as recited in claims 1, 2, or 3, wherein said means for producing a magnetic field is a superconducting magnet.

7. The heat pipe device as recited in claim 6 further comprising means, adjacent said magnet, for cooling said magnet.

* * * * *